US005199914A

United States Patent [19]

Marsh

[11] Patent Number: 5,199,914

[45] Date of Patent: Apr. 6, 1993

[54] FOUR STROKE OUTBOARD MOTOR CRANKCASE OIL DRAIN PLUG OPENING ATTACHMENT

[76] Inventor: Wallace M. Marsh, S. 8900 Mullen Hill Rd., #641, Spokane, Wash. 99204

[21] Appl. No.: 736,228

[22] Filed: Jul. 26, 1991

[51] Int. Cl.[5] ..... B63H 21/38

[52] U.S. Cl. ..... 440/88; 184/1.5

[58] Field of Search ..... 440/88, 89, 900; 114/197; 184/1.5; 137/351

[56] References Cited

U.S. PATENT DOCUMENTS

| | | | |
|---|---|---|---|
| 2,023,007 | 12/1935 | Delano | 184/1.5 |
| 3,858,686 | 1/1975 | Luterick | 184/1.5 |
| 3,874,478 | 4/1975 | Mantell | 184/1.5 |
| 4,756,349 | 7/1988 | Atkins | 184/1.5 |
| 4,875,884 | 10/1989 | Meisenburg | 440/88 |
| 4,946,005 | 8/1990 | Levine | 184/1.5 |
| 4,986,777 | 1/1991 | Preston | 440/88 |

*Primary Examiner*—Jesus D. Sotelo
*Assistant Examiner*—Stephen P. Avila
*Attorney, Agent, or Firm*—Wells, St. John, Roberts, Gregory & Matkin

[57] ABSTRACT

A four stroke outboard motor crankcase drain plug opening attachment is described to facilitate drainage and collection of crankcase oil from four cycle outboard motors. The attachment includes a manually operable valve 20 attached by a fitting 21 to the motor drain plug opening. The valve extends to a flexible downspout 25 that extends on downwardly to an auxiliary plug 30 at a bottom end 27 thereof. The valve includes an operator 22 that can be rotated selectively to open and close the valve. The plug 30 can be selectively removed and adds a redundancy feature to facilitate unintentional drainage of oil by operation of the valve 20. An oil drainage collector 40 including opening 42 and a top end and a bale 45 mounted thereon, may be selectively secured over the valve to facilitate collection of oil. The opening and downspout, and bale are related dimensionally such that the collector container cannot swing free of the downspout when the bale is secured over the valve.

7 Claims, 2 Drawing Sheets

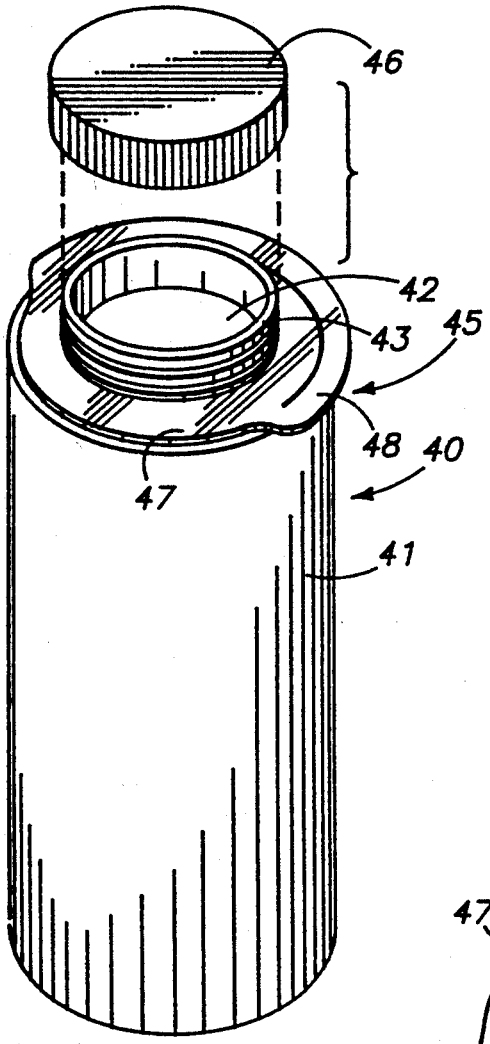
Fig 4
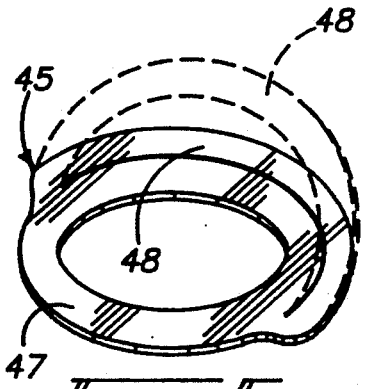
Fig 6
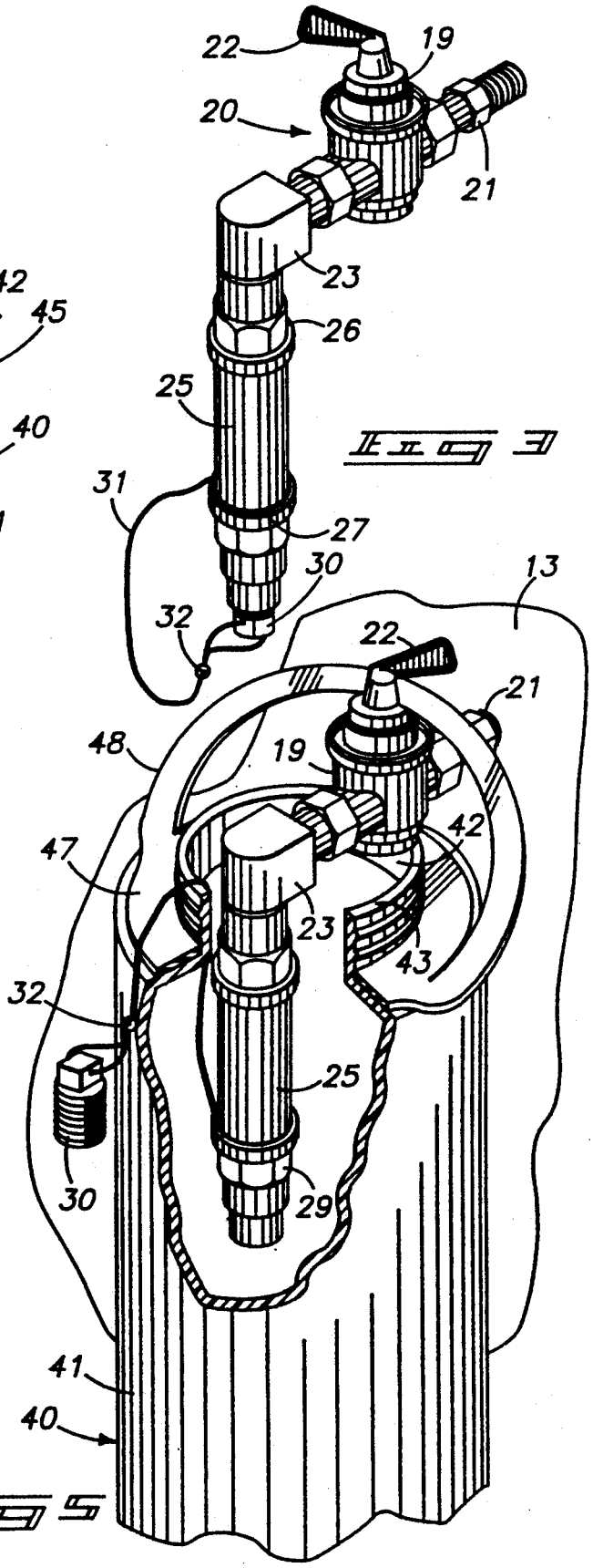
Fig 3
Fig 5

FOUR STROKE OUTBOARD MOTOR CRANKCASE OIL DRAIN PLUG OPENING ATTACHMENT

TECHNICAL FIELD

The present invention relates to draining of crankcase oil from four stroke outboard engines, and more particularly to an attachment for permitting selective draining and collecting of crankcase oil from such motors.

BACKGROUND OF THE INVENTION

Owners who enjoy the advantages of four stroke outboard boat motors are quickly frustrated by the problems they present when it comes time to change the crankcase oil. It is well known and understood that four stroke engines require periodic replacement of crankcase oil.

A considerable frustration comes at oil change time from the location of the crankcase drain plug. Most often, the boat will be in the water with the motor mounted to the transom. The drain plug is situated along the engine drive shaft housing, out over the water and behind the boat. The plug is typically a screw or bolt that simply threads into the crankcase that must be removed in order to drain the oil. If the motor is left on the boat, this must be accomplished by leaning over the engine and positioning oneself in a precarious manner to remove the drain plug.

Then the problem becomes how to collect the draining oil. There is no spout or any form of collection device that will facilitate collection of the draining oil. It typically dribbles down the driveshaft housing and drips in any number of locations into the water below, regardless of attempts to catch it. Environmental regulations and common sense dictate that the oil not be allowed simply to drain into the adjacent water. Thus, the engine must either be removed from the boat and taken to a place where the crankcase oil can be adequately dealt with, or the entire boat must be removed to an adequate facility. This is a frustrating and time consuming experience, especially when the task of changing the oil in the motor is otherwise such a easy and quickly performed task.

Thus, there has been an existing and long-felt need for some form of apparatus by which the oil draining procedure may be accomplished quickly and safely with the motor mounted on the boat and the boat in the water, and without chance that the oil will drain into the water.

The present invention, as will be understood below, provides a unique and unobvious solution to the above problems.

BRIEF DESCRIPTION OF THE DRAWINGS

A preferred form of the present invention is illustrated in the accompanying drawings in which:

FIG. 3 is a perspective view exemplifying a preferred form of the present drain plug opening attachment;

FIG. 4 is a perspective view of a collection bottle used with the present invention;

FIG. 5 is a perspective view illustrating the bottle of FIG. 4 mounted on the drain plug opening attachment of FIG. 3; and FIG. 6 is a view of the bale for the bottle shown in FIGS. 4 and 5.

DETAILED DESCRIPTION OF THE PREFERRED EMBODIMENTS

Figure 1:
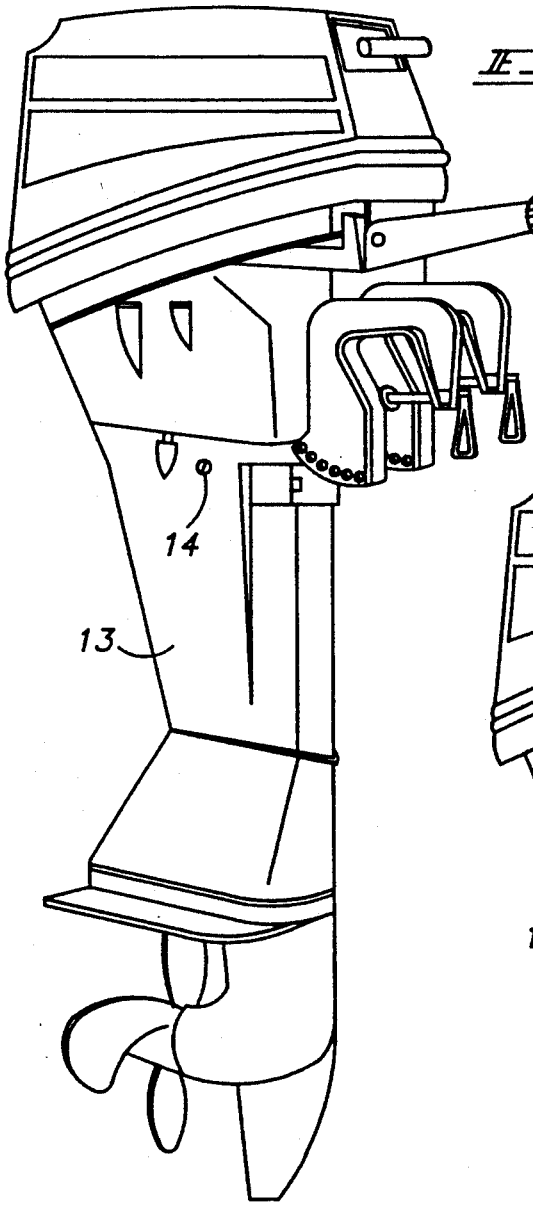
FIG. 1 is a side elevation view of a conventional four cycle outboard motor showing the crankcase drain plug location.
Figure 2:
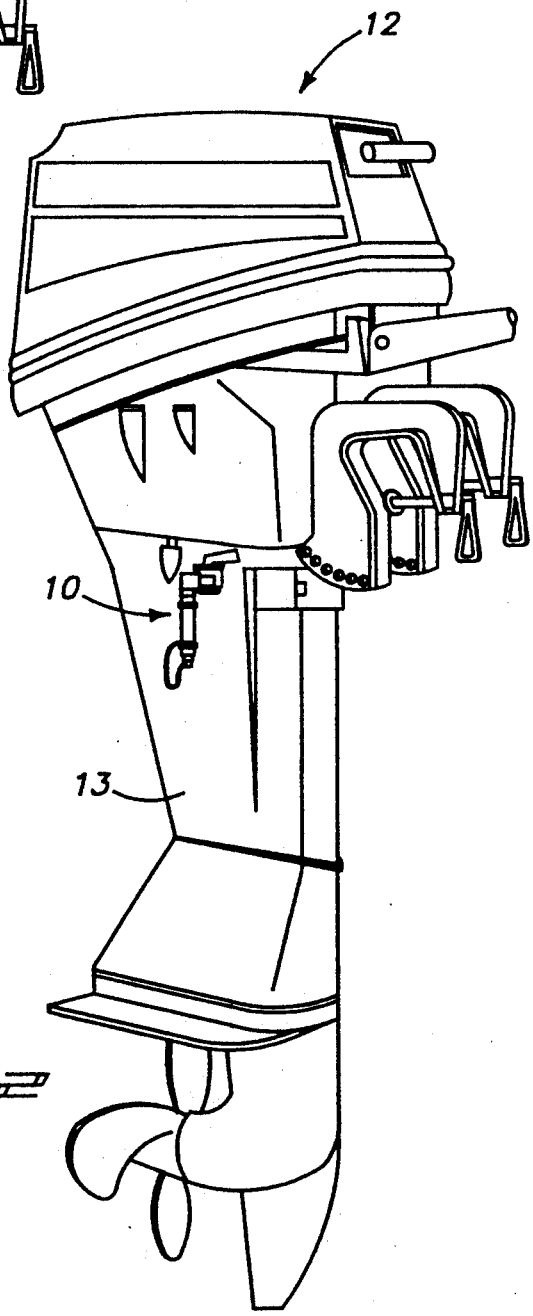
FIG. 2 is a view of the motor shown in FIG. 1 with a drain plug opening attachment exemplifying features of the present invention mounted thereon.

This disclosure of the invention is submitted in furtherance of the constitutional purposes of the Patent Laws "to promote the progress of science and useful arts" (Article 1, Section 8).

An outboard four cycle motor is generally indicated in the drawings by the reference numeral 12. Such outboard motors are manufactured by several different companies around the world. Each model varies somewhat from one to another, but all usually include a drain plug 14 mounted at a position on the motor and communicating with the engine crankcase such that oil may be drained by gravity from the crankcase to facilitate periodic maintenance.

In the outboard 12 exemplified in FIG. 1, the crankcase drain plug 14 is mounted to the drive shaft housing 13. The upper portions of the drive shaft housing 13 enclose portions of the motor crankcase or pan (not shown). The drain plug 14 is typically threaded into a crankcase drain opening that communicates with the engine crankcase. Removal of the drain plug 14 therefore opens the crankcase and allows the oil to drain by gravity from the crankcase.

Without provision of the present invention, described in more detail below, oil draining from the crankcase would simply run down the drive shaft housing 13 and drip at some unknown point from the drive shaft housing to the ground or water surface below. The difficulty experienced by owners of such outboards is predicting where the oil will drip, and the frustration of having the oil run down the outboard drive shaft housing, soiling the painted surfaces of the motor and leaving a residue that becomes a very noticeable "slick" on the water surface when the drive shaft housing is lowered into the water.

The present attachment is shown generally in the drawings by the reference numeral 10. The attachment 10 is provided to facilitate fast, simple and clean drainage of oil from a four cycle outboard motor without the hazard of the oil running down the drive shaft housing, or spilling into or onto the adjacent water or ground surface below. Additionally, the present attachment enables the user to quickly and simply drain the oil by simply removing a plug, attaching a drain bottle, and turning a operator handle to open a valve and allow oil to drain into the bottle. This may be done quickly and easily regardless of the engines location. In fact, it is quite simply accomplished with the engine mounted to a boat and floating in a body of water.

More specifically, the presently exemplified attachment 10 includes a manually operable valve 20 (FIG. 3). The valve 20 includes a fitting 21 at one end. Fitting 21 is specifically machined to replace the crankcase drain plug 14. Thus, the fitting 21 will typically be threaded to accomplish this result. The threads on fitting 21 will match that of the crank case drain plug 14. The fitting includes a central internal bore opening into the body of a conventional valve mechanism 19.

It is preferred that the value mechanism 19 be of a rotating spool type, conventionally known and available on the marketplace. Other forms of valves may also be utilized as well. The preferred valve, however, includes a handle operator 22 that functions by rotation between an open position (FIG. 5) and a closed position (FIG. 3).

The valve 20 includes a spigot 23 leading outward and downwardly therefrom. The spigot 23 may simply be comprised of a conventional "ell" pipe fitting connected to a side of the valve body 19 opposite that of the fitting 24.

A downspout 25 is mounted to the spigot 23 and extends downwardly from a top fitting 26 to a bottom end 27. The top fitting 26 may be comprised of a clamp or other appropriate fixture that will secure the downspout 25 to the spigot 23.

In a preferred form, the downspout 25 is formed of a flexible material such as hydraulic hose material. Such material will deflect upon application of lateral forces to the downspout and move back elastically. This feature facilitates attachment and removal of a container (to be described below) at angles other than strictly along the axis of the downspout 25.

A bottom fitting 29 may be secured by clamping, gluing, etc. to complete the bottom end 27 of the downspout. The fitting 29 receives an auxiliary plug 30. The plug 30 is provided as a redundant safety feature, not permitting drainage of oil even if the valve operator 22 is turned to the open position, unless the plug 30 is removed from the bottom fitting 29. The auxiliary plug 30 is attached by a tether 31 and swivel connection 32 to appropriate valve elements above.

The preferred form of collection container is illustrated at 40 in FIGS. 4 and 5 of the drawings. The collector is preferably a bottle or jar formed of oil impervious plastic material. The container body 41 is of sufficient volume to contain the entire crankcase volume of oil in the motor to which the attachment is to be mounted. Thus, the container bodies may be manufactured with different volume capacities, depending upon the size of the engine crankcase to which the attachment is to be mounted.

The collector container 40 includes an opening 42 at a top end 43. The opening 42 is preferably threaded and may be selectively covered by a cap 46 (FIG. 4). The size of opening 42 is also selected to include a desired opening diameter to be related to the length of the downspout 25 and to the length dimension of a bale member 45 mounted on the container, such that the bale 45 may be connected to the valve (FIG. 5) and the downspout 25 will extend through the opening and into the container in such a manner that the container cannot swing free of the container opening.

More precisely, it is preferred that the downspout 25 include a length dimension greater than the diameter of the collector bottle opening. It is also preferred that the bale 45 include a dimension that, when suspended from the valve 20, will hold the container top end 42 at an elevated position above the downspout bottom end 27 by a distance greater than the diameter of the opening 42. These relationships assure that the container will not unintentionally swing free of the downspout and allow oil to spill onto adjacent surfaces.

The bale member 45 is shown independently in FIG. 6. Bale 45 is preferably formed of a strong, flexible plastic sheet material, stamped in the configuration substantially shown. The bale 45 thus includes an annular base section 47 that is formed to encircle and grip the neck of the collector container opening while the bale portion 48 remains free to be pivoted up and over the valve, or to be used for carrying purposes. The bale is selected with dimensions such that it can be pulled over and secured to the valve, and in so doing, suspend the container with the open mouth thereof elevationally adjacent to the valve with the downspout projecting downwardly into the container as substantially shown in FIG. 5.

The bale member 45 is preferably stamped from sheet material, such as low density polyethylene, in such a manner as indicated in FIG. 5 with a slit to define the bale part 48. Ends of the bale are integral with the base part 47.

Installation and operation of the present attachment is easily accomplished and may be easily understood in view of the above description and the accompanying drawings. To install the present apparatus, the user simply initially removes the crankcase drain plug 14 (FIG. 1). This leaves the drain plug opening free to receive the valve fitting 21. This is attached simply by threading the fitting into the drain plug opening. A conventional wrench may be utilized for this purpose.

Installation is complete when the fitting 21 is securely attached within the drain opening and the downspout 25 is oriented in a preferably vertical downward direction. The attachment is now ready for use.

To drain oil from the motor crankcase, the user simply removes the auxiliary plug 30 from the downspout bottom end 27. This step is accomplished using ordinary tools.

Next the drainage collector container 40 is attached to the valve. This is done by inserting the collector container opening over the downspout and attaching the bale 45 to the valve, preferably over the operator 22 as shown in FIG. 5.

Next, the operator 22 is turned to open the valve. This opens passage to the motor crankcase and allows the oil to drain downwardly into the container. The attachment is left in this orientation until all of the oil has drained from the crankcase. Then, the user simply rotates the operator 22 back to the "off" position to stop any further oil drainage.

The container is then removed from the valve by lifting the bale upwardly and lowering the container from the downspout 25. The container is now free of the attachment and the cap 46 may be placed over the container opening to secure the used oil.

The auxiliary plug 30 may now be replaced to secure the attachment against undesired opening through rotation of the operator 22. New oil can now be poured into the crankcase through the motor oil fill spout (not shown).

The used oil can be disposed of using acceptable, environmentally sound procedures, such as recycling. Once the used oil is disposed of, the container can be stored until the next oil change time.

It is noted that the above procedure is accomplished without danger of oil falling from the container to the water or other surface below. There is little hazard of any oil being spilled during this procedure, especially due to the redundancy of the valve 20 and auxiliary plug 30. Thus, the present attachment provides a fast and easy vehicle by which crankcase oil may be drained from an outboard four cycle engine, alleviating the tedious problem recognized by many such outboard owners. The procedure is not only quick, but is clean and environmentally safe. The drained oil is collected in an appropriate container and can be disposed of in known, environmentally sound ways.

Still further, the dimensions of the present valve attachment assembly are such that it can be installed and remain in the installed location on a four cycle outboard motor permanently. With the present attachment, the adjacent four cycle outboard motor 12 can be operated in the usual manner. Thus, the motor may be turned, tipped, etc. without fear that the attachment will strike any adjacent structures.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A four stroke outboard motor crankcase oil drain plug opening attachment, comprising:

a manually operable valve having a spigot and a valve operator;

a fitting adapting the manually operable valve to a drain plug opening in an outboard motor having a crankcase and spacing the manually operable valve outward of the crankcase;

a downspout mounted to the manually operable valve and extending downwardly therefrom;

an oil drainage collector container having an upper end configured to receive the downspout therethrough;

wherein the oil drainage collector container includes a bale means adjacent the upper end for releasably suspending the oil drainage collector container from the manually operable valve with the downspout extending through the upper container end and into the container wherein the upper end of the container includes an opening with a dimension across the opening less than the prescribed length dimension of the downspout; and wherein the bale is arranged to suspend the container from the manually operable valve with a portion of the downspout length extending into the container through the container opening, the length of the portion extending into the container being greater than the dimension across the opening such that the container is not permitted to unintentionally swing free of the downspout.

2. A four stroke outboard motor crankcase drain attachment, as claimed by claim 1 wherein the downspout extends to a bottom end, and further including an auxiliary drain plug threadably engaging the bottom end of the downspout and connected by a tether to the downspout.

3. A four stroke outboard motor crankcase drain attachment, as claimed by claim 1 wherein the downspout is flexible.

4. A four stroke outboard motor crankcase drain attachment, as claimed by claim 1 wherein the downspout extends to a bottom end and further includes a plug engaging the bottom end of the downspout;

a tether connecting the plug to the downspout; and wherein the downspout is flexible along its length between the manually operable valve and the bottom end.

5. A four stroke outboard motor crankcase drain plug opening attachment, comprising:

a manually operable valve having a spigot and valve operator;

a fitting adapting the valve to a drain plug opening in an outboard motor having a crankcase and spacing the manually operable valve outward of the crankcase by a selected distance;

a downspout mounted to the manually operable valve spigot and extending downwardly therefrom to a bottom end;

an auxiliary drain plug releasably mounted to the downspout at the bottom end thereof;

an oil drainage collector container having an open upper end adapted to receive the downspout and including a bale; and means on the manually operable valve for receiving the bale with the downspout received through the open upper end of the collector container and for directly suspending the container from the manually operable valve with the downspout extending into the container.

6. A four stroke outboard motor crankcase drain attachment, as claimed by claim 5 wherein the downspout is flexible.

7. A four stroke outboard motor crankcase drain plug opening attachment, comprising:

a manually operable valve having a spigot and a valve operator;

a fitting adapting the manually operable valve to a drain plug opening in an outboard motor having a crankcase and spacing the manually operable valve outward of the crankcase;

a flexible downspout mounted to the manually operable valve and extending downwardly therefrom a prescribed length dimension to a bottom end;

an auxiliary drain plug threadably engaging a bottom end of the flexible downspout;

a tether connecting the auxiliary drain plug to the downspout, the tether having a swivel thereon to permit rotation of the auxiliary drain plug and a length dimension sufficient to allow the auxiliary drain plug to be removed from the bottom downspout end;

an oil drainage collector container having an upper end configured to receive the downspout therethrough; and wherein the oil drainage collector container includes a bale means adjacent the upper end for releasably suspending the oil drainage collector container from the manually operable valve with the downspout extending through the upper container end and into the container;

wherein the upper end of the container includes an opening with a dimension across the opening less than the prescribed length dimension of the downspout; and wherein the bale is arranged to suspend the container from the manually operable valve with a portion of the downspout length extending into the container through the container opening, the length of the portion of the downspout extending into the container being such that the container is not permitted to unintentionally swing by the bale free of the downspout.

* * * * *